US005546608A

United States Patent [19]

Russano

[11] Patent Number: 5,546,608

[45] Date of Patent: Aug. 20, 1996

[54] UNDERGARMENT

[76] Inventor: Jama K. Russano, 123 Soundview Ter., Northport, N.Y. 11768

[21] Appl. No.: 865,056

[22] Filed: Apr. 8, 1992

Related U.S. Application Data

[63] Continuation-in-part of Ser. No. 702,056, May 17, 1991.

[51] Int. Cl.[6] ..... A41D 9/00; A41B 9/00

[52] U.S. Cl. ..... 2/408; 2/406; 450/102

[58] Field of Search ..... 2/73, 75, 80, 79, 2/109, 111, 227, 400, 401, 402, 403, 406, 407, 408, 409; 450/102, 103, 104, 105; 604/358, 395, 396

[56] References Cited

U.S. PATENT DOCUMENTS

| | | | |
|---|---|---|---|
| 1,083,712 | 1/1914 | Uyeda | 2/408 X |
| 1,169,500 | 1/1916 | Leavitt et al. | 2/402 |
| 1,469,287 | 10/1923 | Torchia | 2/408 |
| 1,692,350 | 11/1928 | Robertson | 2/408 |
| 2,052,598 | 9/1936 | Berg | 604/395 |
| 2,061,991 | 10/1935 | Davis | 2/408 X |
| 2,206,412 | 7/1940 | Levy | 2/406 |
| 2,277,068 | 3/1942 | Bulloch | 2/408 |
| 2,381,232 | 8/1945 | Stone | 450/105 X |
| 2,397,641 | 4/1946 | Blair | 2/408 X |
| 2,453,063 | 11/1948 | Cohen | 450/103 |
| 2,478,263 | 8/1949 | Geitz | 2/408 X |
| 2,531,772 | 11/1950 | Erteszek | 2/408 |
| 2,591,079 | 4/1952 | Leaton | 2/402 X |
| 2,617,101 | 11/1952 | Weintraub | 2/408 |
| 2,621,335 | 12/1952 | Sheldon | 2/402 |
| 2,638,900 | 5/1953 | Gruenberg et al. | 2/400 X |
| 2,660,173 | 11/1953 | Erteszek | 604/395 |
| 2,921,583 | 1/1960 | Lerner | 2/402 |
| 3,068,488 | 12/1962 | Rodriguez | 2/408 X |
| 3,140,718 | 7/1964 | Farkas | 450/103 |
| 3,154,082 | 10/1964 | Cape | 2/408 X |
| 3,212,500 | 10/1965 | Bardy | 604/395 |
| 3,279,469 | 10/1966 | Schustack | 2/408 X |
| 3,746,009 | 7/1973 | Cuozzi | 450/105 |
| 3,974,836 | 8/1976 | Carlson | 2/408 X |
| 4,022,212 | 5/1977 | Levison | 604/395 |
| 4,114,621 | 9/1978 | Mims, Jr. | 604/395 |
| 4,280,230 | 7/1981 | La Fleur | 2/408 |
| 4,446,575 | 5/1985 | Davis | 2/408 X |
| 4,533,355 | 8/1985 | Fair | 2/238 X |
| 4,597,110 | 7/1986 | Smith, Sr. et al. | 2/408 |
| 4,637,078 | 1/1987 | Southwell | 2/408 |
| 4,834,737 | 5/1989 | Khan | 604/395 X |
| 4,835,795 | 6/1989 | Lonon | 2/408 |
| 4,937,887 | 7/1990 | Schreiner | 2/402 |

FOREIGN PATENT DOCUMENTS

| | | | |
|---|---|---|---|
| A019656 | 5/1915 | France | 604/396 |
| 645649 | 10/1928 | France | 604/395 |
| 1522370 | 4/1968 | France | 450/104 |
| 139568 | 6/1934 | Germany | 2/408 |
| 2202330 | 8/1973 | Germany | 450/102 |
| 6929 | 5/1900 | United Kingdom | 2/408 |
| 475885 | 8/1951 | United Kingdom | 2/400 |
| 1198902 | 7/1970 | United Kingdom | 2/402 |
| 2208263 | 3/1989 | United Kingdom | 2/408 |

*Primary Examiner*—Jeanette E. Chapman
*Attorney, Agent, or Firm*—Middleton & Reutlinger; Charles G. Lamb

[57] ABSTRACT

An undergarment is provided which affords a patient a sense of dignity and modesty while affording medical personnel access to the patient's crotch. This undergarment has a flap which acts to cover or uncover an opening in the crotch area of the undergarment. Such access may be sued for the insertion of a catheter which may continue being used while the patient wears the undergarment, thereby preventing exposure of the patient's buttocks and genitalia to other persons present.

2 Claims, 5 Drawing Sheets

FIG. 1
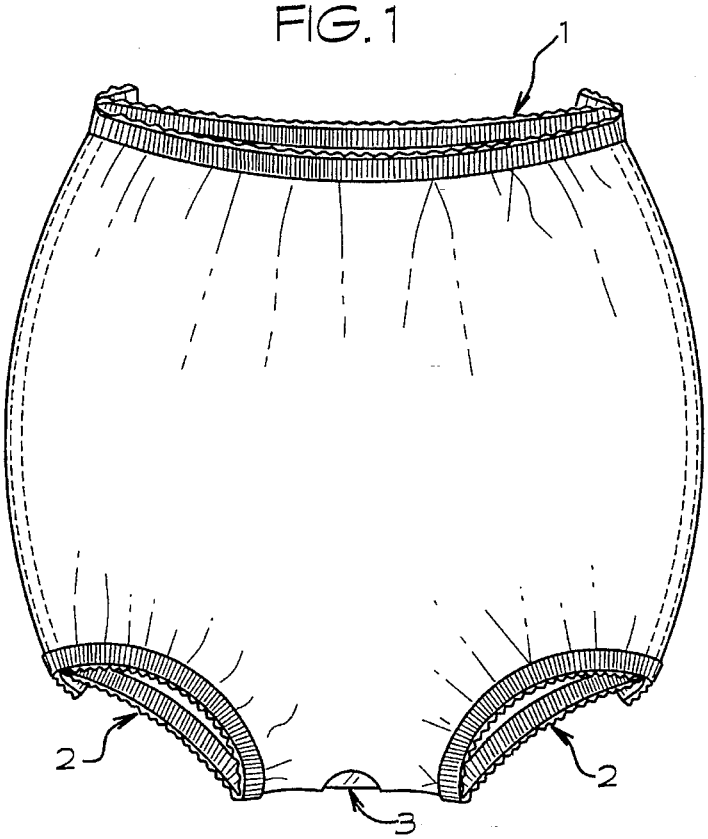
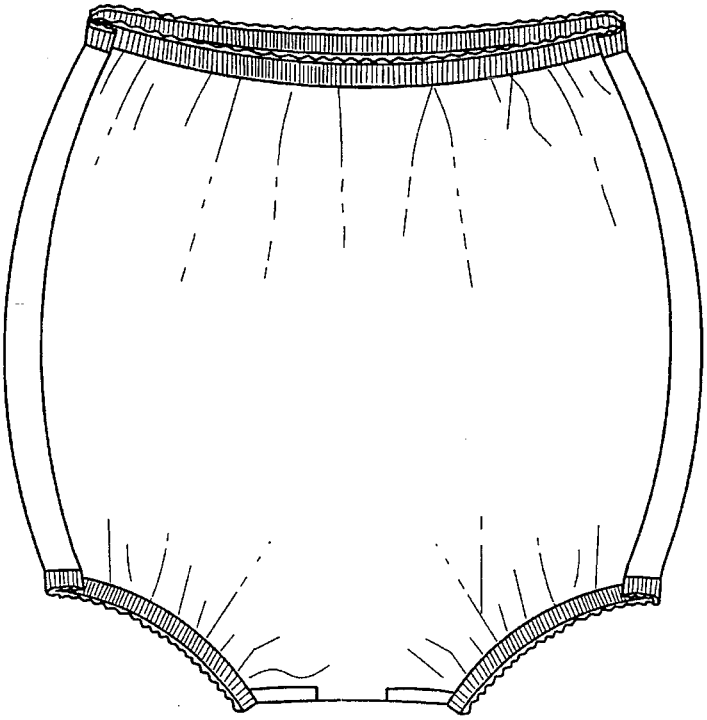
FIG. 2

UNDERGARMENT

CROSS-REFERENCE TO RELATED APPLICATIONS

This is a continuation-in-part patent application of my co-pending application having a Ser. No. 07/702,056 and a filing date of May 17, 1991.

BACKGROUND OF THE INVENTION

The subject invention is an undergarment which provides a patient with a modicum of privacy and a sense of modesty by allowing the majority of the patient's buttocks and pelvic area to be covered, while providing medical personnel with access to the patient's crotch area for procedures such as catheterization. The undergarment provides the advantages of easy access by a physician or medical personnel coupled with easy entry and closure of the garment. Moreover, the undergarment opens to a flat condition so that an ambulatory patient can be rolled onto the undergarment to facilitate application.

U.S. Pat. No. 4,258,440, issued Mar. 31, 1981, to McGowen, teaches a garment adapted for wear by physically handicapped persons who are incapable of executing normal dressing movements. McGowen teaches the use of VELCRO-type closures for an undergarment. The advantage of the McGowen invention is that a nurse or attendant may apply the garment to a patient without lifting the patient by rolling the patient left and right without lifting of the torso or extremities. This advantage is also present in the subject invention. The long felt need for a garment which affords a patient a sense of dignity and well-being, was expressed in U.S. Pat. No. 4,570,268, issued Feb. 18, 1986, to Freeman. However, Freeman's patient garment is only directed to conventional style gowns and not a brief/panty-type undergarment.

The use of self-administrable garments are known in the art. For example, Pettis describes in U.S. Pat. No. 4,644,589, issued Feb. 24, 1987, a self-administrable garment for use by persons having limited leg and/or arm movement. The Pettis garment utilizes VELCRO-type closures to enable the garment to be easily opened and closed. Ramirez teaches a two-piece disposal hospital gown which utilizes VELCRO-type closures or adhesive means to fasten the sides of the pants together. Although the garment of Ramirez includes an openable fly having a tape which fastens the edges over the front section of the pants leg, nowhere is a means of accessing the patient's crotch disclosed.

The subject invention provides an undergarment, typically in the form of a brief or panty, which offers an openable flap which allows ready access to the patient's crotch. This feature allows a medical practitioner to access a patient's groin while affording the patient a sense of privacy since the patient's genitalia and buttocks are covered. When the flap is in the closed position, the undergarment functions as a normal brief/panty and hence, can be used on patient's both pre- and post-catheterization.

SUMMARY OF THE INVENTION

The subject invention provides an undergarment which comprises a front panel applicable to the front of a person's torso and a rear panel applicable to the back of a person's torso. The front and rear panels are connected in such a manner so as to provide an opening at a position corresponding to a person's crotch and have side edge margins with fastening means situated thereon for assembling and securing the garment to the person's torso by interconnecting the front and rear panels along their opposing edge margins. The undergarment may also be formed from a single panel as described herein. A flap is situated so as to move from a first position in which the crotch opening of the garment is open to a second position in which the crotch opening of the garment is closed.

Preferably, the undergarment comprises means for securely holding the top of the undergarment to the person's waist area, such as an elastic band or drawstring, and means for securely maintaining the undergarment about the person's thighs such as an elastic band.

BRIEF DESCRIPTION OF THE FIGURES

FIG. 1. A front view of a preferred embodiment of the subject undergarment showing the flap in a closed position.

FIG. 2. A rear view of a preferred embodiment of the subject undergarment showing the flap in a closed position.

DESCRIPTION OF THE INVENTION

Figure 3:
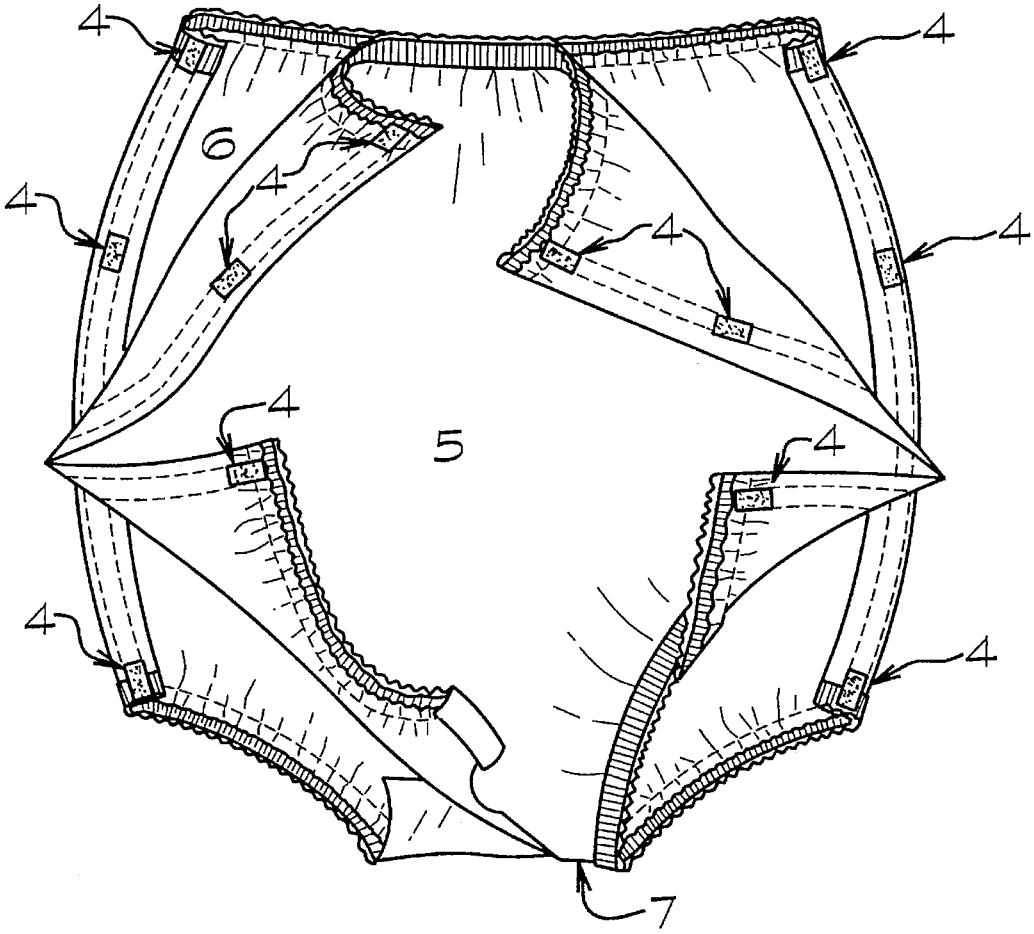
FIG. 3. A front view of a preferred embodiment of the subject undergarment showing the closures in the open position and the front panel lifted at the corners.

The subject invention provides an undergarment which affords a person a sense of dignity while allowing medical personnel access to the person's crotch/groin. Such a garment is suitable for use both at home and in medical care facilities.

The following describes a preferred embodiment of the invention and it is not intended to, nor should it be construed to, restrict the present invention as set forth in the claims. FIG. 1 shows a front view of the subject undergarment. Elastic bands (1) and (2) are present at the waist and leg of the undergarment, respectively. It should be understood, however, that other means of securely keeping the undergarment in place may also be used (e.g., rubberbands, tape fasteners, or a drawstring). Conversely, the undergarment may not employ this feature at all and may be loosely fitted at the legs or waist.

The undergarment may be formed of any material suitable for contact with human skin, such material includes cotton, paper, nylon, wool, polyester, acetate, polypropylene, linen, satin, silk or blends thereto. Such garment may be either recyclable or disposable. Referring to FIG. 2, the rear view of the undergarment is typically similar to the front view, however, the opening (3) for the catheter or other access is typically not visible. The actual styling of the undergarment may vary. Such styling is readily determinable by one skilled in the art of brief/panty design. It is most advantageous, however, that the undergarment be designed to open to a flat condition so that a patient may be rolled onto the undergarment without having to be lifted. VELCRO-type fasteners (4), tape fasteners, snaps, zippers or other suitable means, such as cords which may be tied, may be utilized to join the front (5) and rear (6) panels at the patient's side.

FIG. 3 shows a front view of the subject undergarment wherein the VELCRO-type fasteners (4) which hold the side seams together in the closed position are unfastened and the front panel (5) is pulled up at the edges. As depicted, VELCRO-type closures (4) are present on both side seams. It should be noted, however, that other loop and filament type closures as well as snap-type devices or tape fasteners may be utilized for maintaining the garment in the closed position. As indicated in this figure, the preferred subject garment comprises a front panel (5) and a rear panel (6) which are attached on one side of the groin seam (7). It is contemplated that the garment may comprise a single panel with the opening in the crotch-groin area being cut into the garment.

Figure 4:
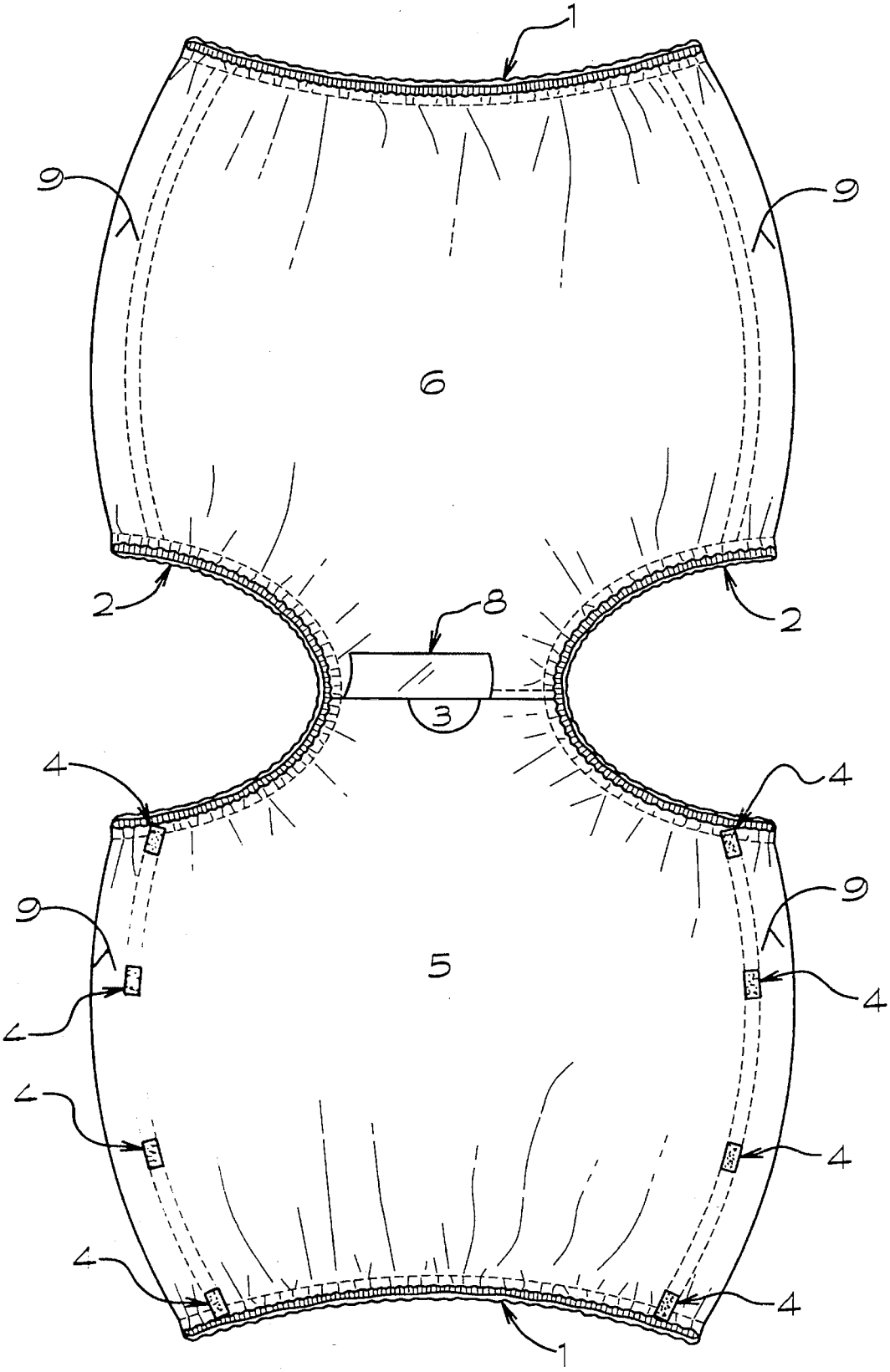
FIG. 4. A top view of the interior of a preferred embodiment of the undergarment in the open position.

FIG. 4 shows one preferred embodiment of the subject undergarment in the open position looking at the interior of the garment wherein the garment panels (5) and (6) are of unitary construction. As can be seen in this figure, the VELCRO fasteners (4) are most preferably located on the inner side edges of the front panel (5) and on the outer side edges of the rear panel (6). A flap (8) is provided as a means to cover opening (3) in a closed position or to leave opening (3) in an open position, as required. Preferably flap (8) is a preselected configured shape of the same material as the front and rear panels (5) and (6), respectively, and is sized to just cover the opening (3) in a closed position. Preferably, flap (8) is attached to either panel (5) or (6) or at the juncture of the two panels as shown flap (8) is positioned and sized to cover the opening (3). Even though the flap (8) may be of many different configurations as long as the flap (8) is of sufficient size to cover the opening (3), this is the essential requirement. In FIG. 4, the flap (8) is rectangular in shape. And, the attachment is generally along only one of its side. In the attaching, the flap (8) is positioned over the opening (3) and appropriate attaching means, such as sewing, is utilized for the attachment. As can be readily seen from this figure, the flap (8) may be folded inward to provide an opening (3). The flap (8) lies against the patient when a catheter is in use or the groin needs to be accessed. Flap (8) may be folded over to cover opening (3) when access to the groin of the patient is not required. By the placing of the VELCRO closures on the inside of the front panel (5) and the outside of the rear panel (6) near the side edges allows for a more secure fitting garment which lies flatter and is less susceptible to unintentional opening. As shown in FIG. 4, there is an area of material which extends laterally beyond the VELCRO closure (9). This additional area imparts resistance to tear strain caused by the interlocking of the VELCRO on the front and rear panels, and also provides an overlap to insure that the joinder of the VELCRO does not gap and allow visualization of the patient's body at the point of gaping.

Figure 5:
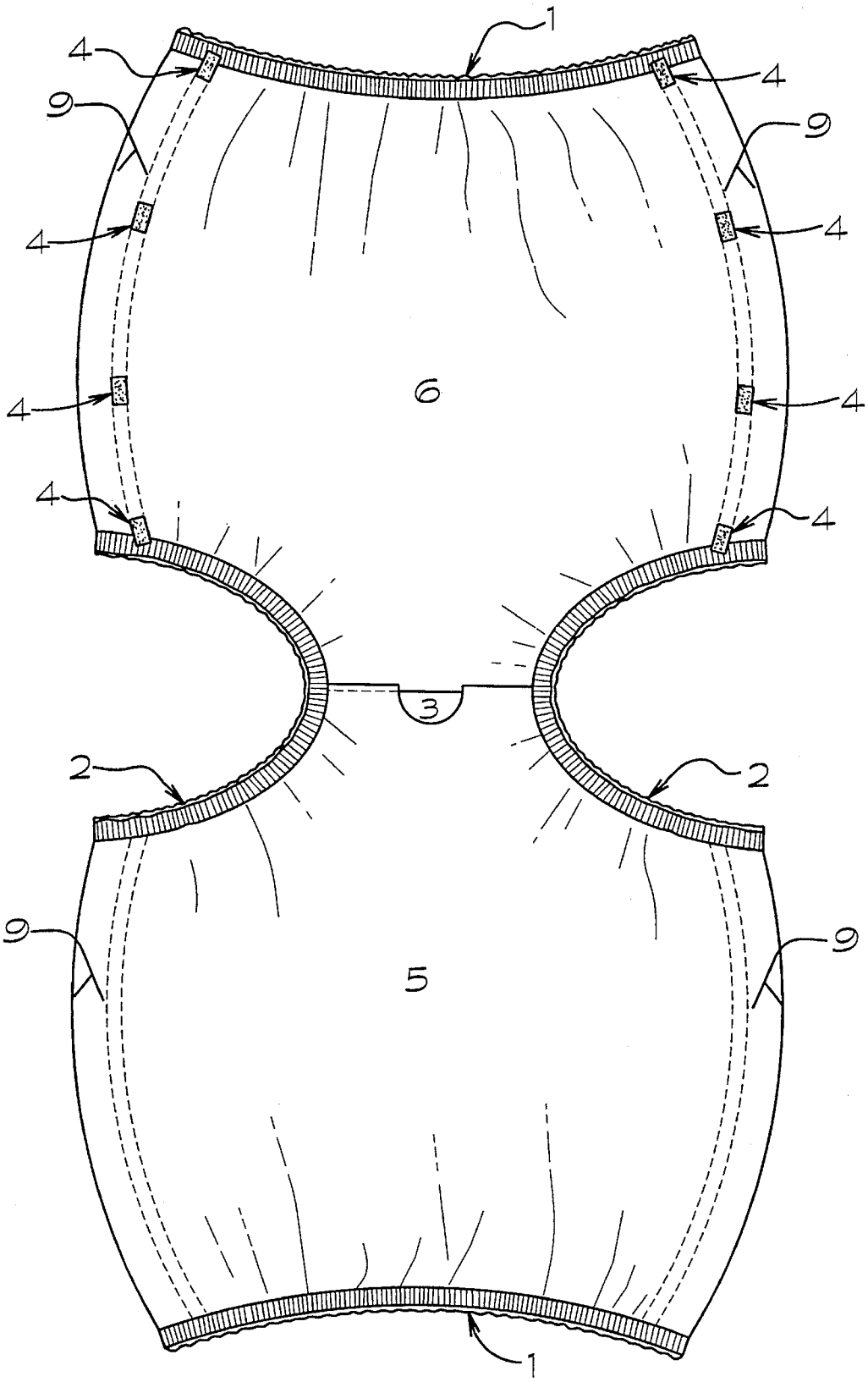
FIG. 5. A top view of the exterior of a preferred embodiment of the undergarment in the open position.

FIG. 5 shows an exterior view of the undergarment of FIG. 4 in the open position.

Figure 6:
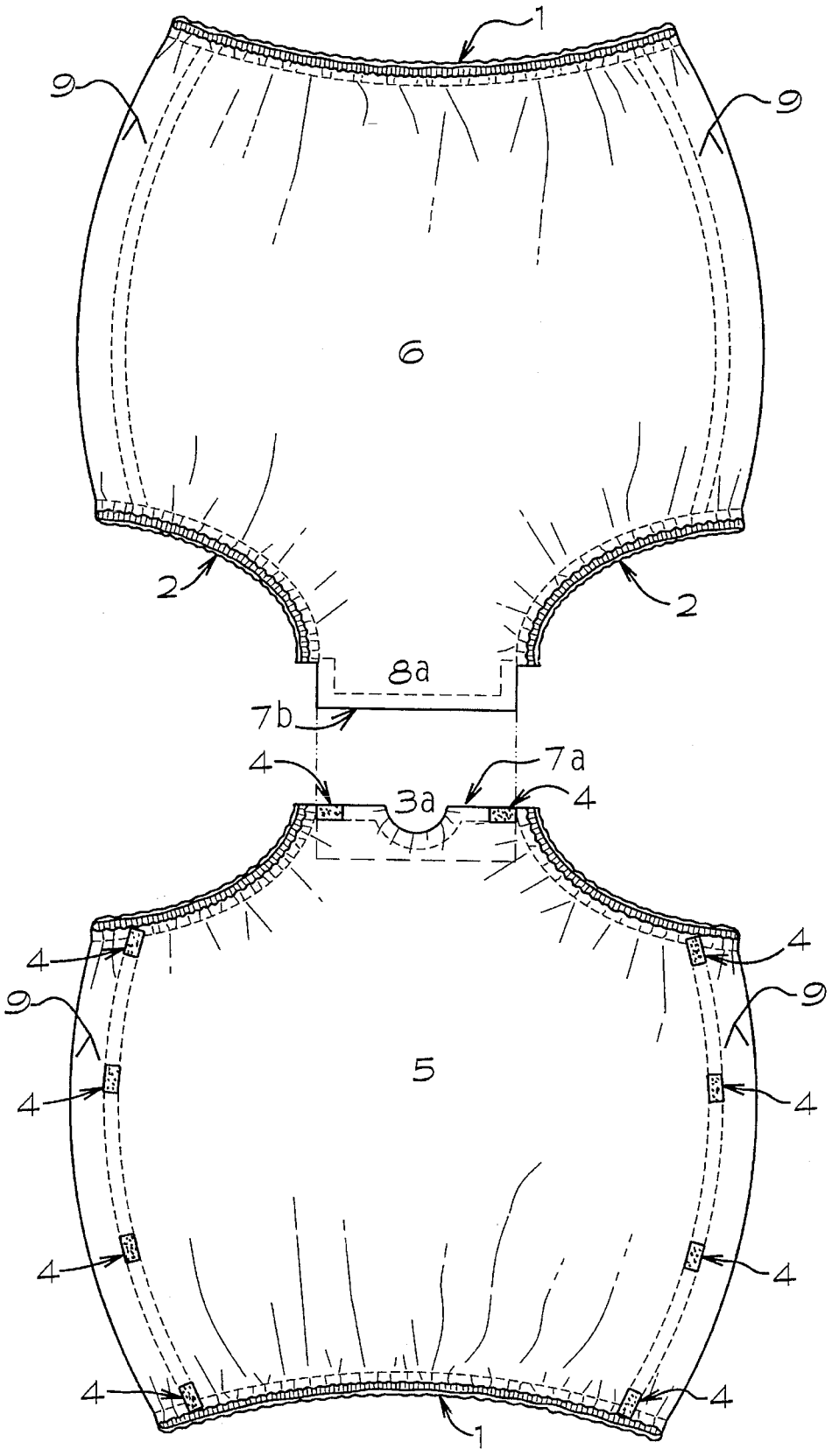
FIG. 6. A top view of the exterior of another preferred embodiment of the present invention in the open position.

FIG. 6 shows another preferred embodiment of the present invention wherein the front panel (5) is made from one piece of material and the back panel (6) is made from a second piece of material. In this embodiment a preselected shape, such as a cut-out (3*a*) is provided in the crotch or groin seam area, as depicted by the numeral (7*a*) in one panel, such as panel (5), and an outwardly extending flap (8*a*) is provided in the crotch or groin seam area (7*b*) in the other panel. The outwardly extending flap (8) is of rectangular configuration with one edge integral with the groin area (7*b*) of panel (6). The flap (8*a*) is shaped so that the flap (8*a*) is connected to the panel (6) only along one side. Detachable fastening means, such as VELCRO-type fasteners (4) are provided in the groin seam areas (7*a*) and (7*b*) (not shown) to attach and hold the two panels (5) and (6) together along the groin area. When the panels (5) and (6) are attached along the individual groin seams (7*a*) and (7*b*), a crotch area is defined and an opening is defined at the cut-out (3*a*). In this attached position, flap (8*a*) covers the cut-out or opening (3*a*) in the closed position, and leaves the opening (3*a*) open in an open position. (Phantom lines are utilized to show the location of flap (8*a*) when the panels (5) and (6) are connected.)

Upon reading the subject application various embodiments, modifications and alterations will become obvious to one skilled in the art. These various embodiments, modifications and alterations are to be considered within the scope and spirit of the subject invention which is only to be limited by the claims which follow and their equivalents.

What is claimed is:

1. An undergarment for physically handicapped persons which comprises:

a) a front panel applicable to a front of a person's torso;

b) a rear panel applicable to a back of a person's torso, the front and rear panels being connected, one of said panels having a cut-out at said connection defining an opening therein, said connection being in such a manner so as to provide said opening at a position corresponding to a person's crotch and having side edge margins with fastening means situated thereon for assembling and securing the garment to the person's torso by interconnecting the front and rear panels along the opposing edge margin, wherein said front panel and said rear panel include attaching means at the crotch, said attaching means positioned to cooperate between said front panel and said rear panel in attaching said panels at said crotch; and c. a flap attached to at least one panel, said flap being positioned along said crotch opening and of sufficient size to cover said opening in a closed position, said flap being positioned on the inside of the crotch opening, said flap situated so as to move from a first position in which the crotch opening of the undergarment is open to a second position in which the opening of the undergarment is closed.

2. An undergarment for physically handicapped persons which comprises:

a. a panel applicable to the front and rear of a person's torso, said panel having an opening at a position corresponding to the person's crotch and having side edge margins with fastening means situated thereon for assembling and securing the garment to the person's torso by interconnecting opposing portions of the side edge margins, said panel being detachable at said crotch from said opening at at least one side edge margin; and b. a flap attached to said panel, said flap being positioned along said crotch opening and of sufficient size to cover said opening in a closed position, said flap being positioned on the inside of the crotch opening, said flap situated so as to move from a first position in which the crotch opening of the undergarment is open to a second position in which the crotch opening of the undergarment is closed.

* * * * *